US007291232B2

(12) United States Patent
Kamf

(10) Patent No.: US 7,291,232 B2
(45) Date of Patent: Nov. 6, 2007

(54) PROCESS FOR HIGH STRENGTH, HIGH CONDUCTIVITY COPPER ALLOY OF CU-NI-SI GROUP

(75) Inventor: Claes Anders Kamf, East Amherst, NY (US)

(73) Assignee: Luvata OY, Espoo (FI)

( * ) Notice: Subject to any disclaimer, the term of this patent is extended or adjusted under 35 U.S.C. 154(b) by 366 days.

(21) Appl. No.: 10/668,931

(22) Filed: Sep. 23, 2003

(65) Prior Publication Data

US 2005/0061405 A1 Mar. 24, 2005

(51) Int. Cl.
*C22F 1/08* (2006.01)

(52) U.S. Cl. ..... 148/682

(58) Field of Classification Search ..... 148/682
See application file for complete search history.

(56) References Cited

U.S. PATENT DOCUMENTS 3,985,589 A * 10/1976 Shapiro et al. ..... 148/686
4,950,451 A * 8/1990 Nakajima et al. ..... 420/481
5,306,465 A 4/1994 Caron et al.
5,846,346 A 12/1998 Lee et al.

FOREIGN PATENT DOCUMENTS

| | | |
|---|---|---|
| JP | 61250154 | * 11/1986 |
| JP | 03162553 | * 7/1991 |
| JP | 08319527 | * 12/1996 |
| RU | 2068449 | * 10/1996 |
| SU | 1127321 | * 5/1992 |

* cited by examiner

*Primary Examiner*—Sikyin Ip
(74) *Attorney, Agent, or Firm*—Hodgson Russ LLP

(57) ABSTRACT

A process for producing a copper-nickel-silicon alloy having a yield strength above 90 ksi with an electrical conductivity above 50% IACS. The process includes melting and continuously casting raw material to obtain an alloy containing 1-3 wt. % nickel, 0.2 to 0.7 wt. % silicon, remainder copper and unavoidable impurities; cold delivering the alloy to form a cold-rolled alloy, solution annealing the cold-rolled alloy; cold rolling the annealed alloy; and precipitation annealing the cold-rolled annealed alloy at a temperature of 450-500 degrees C. for four to ten hours with a cooling rate of 10-20 degrees C. per hour.

17 Claims, 3 Drawing Sheets

Yield strength and electrical conductivity for material annealed in a batch furnace for 4 to 10 h at 480° C.

Yield strength and electrical conductivity for material annealed in a batch furnace for 4 h at different temperatures.

Yield strength and electrical conductivity for material annealed in a batch furnace for 8 h at different temperatures.

Yield strength and electrical conductivity for material annealed in a batch furnace for 8 h at different temperatures.

Yield strength and electrical conductivity for material annealed in a batch furnace for 4 to 10 h at 480° C.

PROCESS FOR HIGH STRENGTH, HIGH CONDUCTIVITY COPPER ALLOY OF CU-NI-SI GROUP

FIELD OF INVENTION

The present invention relates to precipitation hardening alloys and, in particular, to a process for manufacturing high strength, high conductivity copper alloys of the Cu—Ni—Si group.

BACKGROUND

One type of precipitation hardening copper alloy is the copper-nickel-silicon alloy with a nominal 2% nickel, 0.45% silicon and remainder copper. This alloy combines excellent stress relaxation resistance with high strength and high conductivity. The combination of strength, formability and conductivity is reached through a thermo-mechanical process combining cold deformation and heat treatments.

In order to obtain high electrical conductivity, it is necessary to have a high degree of precipitation of the alloy elements. The size and fraction of the precipitates are also important for the resulting microstructure and consequently for the mechanical properties. A dispersion of fine precipitates can retard recrystallization or hinder grain growth and also increase the strength. Depending on the size and amount of precipitates, different combinations of properties are achieved.

EXAMPLE 1

An example of a typical process for forming copper-nickel-silicon alloys is casting, hot rolling, cold rolling, solution annealing, cold rolling, and final precipitation annealing. The precipitation annealing is typically done in a batch type furnace at a temperature between 390° C. and 460° C. for four to eight hours. The expected properties are a yield strength above 80 ksi in combination with an electrical conductivity above 40% IACS (IACS stands for International Annealed Copper Standard where pure copper has an electrical conductivity of 100%).

In Example 1, a copper alloy that was formed with the typical process set forth above was precipitation annealed in a batch furnace for four hours at temperatures between 390° C. and 430° C. using a cooling rate to 300° C. of 30-50° C./hour. The result after annealing is shown in FIG. 1. The alloy reached a yield strength between 94 to 97 ksi with an electrical conductivity of approximately 43% IACS.

EXAMPLE 2

A copper alloy formed with the typical process described above in connection with Example 1 was precipitation annealed in a batch furnace for eight hours at temperatures between 425° C. and 460° C. using a cooling rate to 300° C. of 30-50° C./hour. The result after annealing is shown in FIG. 2. The yield strength for the material decreased with increasing temperature from about 93 ksi to 79 ksi. At the same time, the electrical conductivity increased from 45 to 58% IACS. As shown in this figure, it was not possible to reach a combination of a yield strength above 90 ksi with an electrical conductivity above 50% IACS.

Accordingly, there is a need for a process capable of producing a copper-nickel-silicon alloy having a yield strength above 90 ksi with an electrical conductivity above 50% IACS.

SUMMARY

The present invention meets the above-described need by providing a process for producing a copper-nickel-silicon alloy having a yield strength above 90 ksi with an electrical conductivity above 50% IACS.

BRIEF DESCRIPTION OF THE DRAWINGS

The invention is illustrated in the drawings in which like reference characters designate the same or similar parts throughout the figures of which.

DETAILED DESCRIPTION

Precipitation hardening copper alloys are used to achieve a combination of high strength, high electrical conductivity and good formability. The present invention will be described in connection with a copper-nickel-silicon alloy having minimum 99.5% content by weight of Cu, Ni, Si, and P. The balance of the alloy includes inevitable impurities. The nickel comprises from 1-3% of the alloy. The silicon comprises 0.2-0.7% of the alloy, and phosphorous comprises a maximum of 0.010%.

Figure 5:
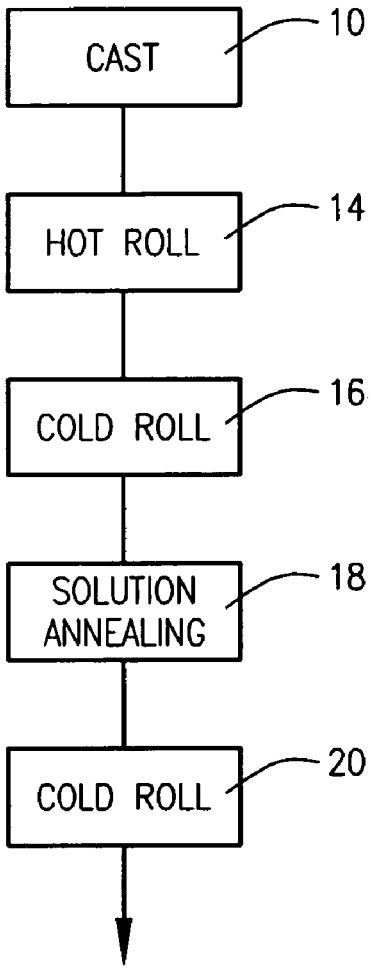
FIG. 5 shows in block diagram the initial processing of a copper alloy containing nickel and silicon in accordance with the invention.
Figure 6:
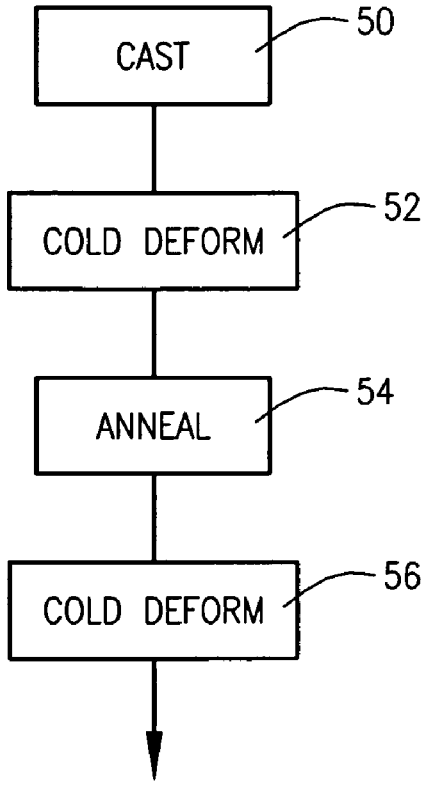
FIG. 6 shows in block diagram an alternative for initial processing of the copper alloy for high strength and high electrical conductivity.
Figure 7:
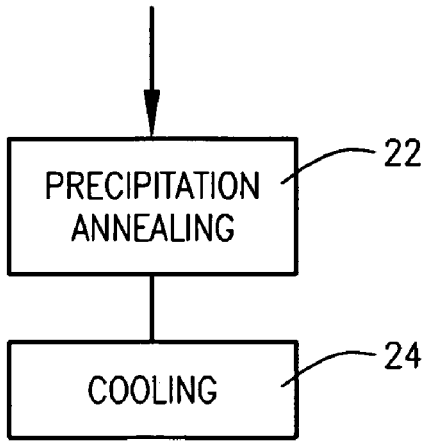
FIG. 7 shows in block diagram the final processes for producing the inventive copper alloy.

Referring to FIGS. 5-7, the alloy of the present invention is produced through a combination of cold deformation and heat treatments. In one example of the initial processing shown in FIG. 5, the alloy is first cast 10 into an ingot. The ingot is then hot rolled 14 into a strip. The strip is then cold rolled in a first cold rolling step 16 prior to solution annealing 18. After solution annealing 18, the strip is cold rolled in a second cold rolling step 20.

The above steps are an example of initial processing prior to precipitation annealing 22. As will be evident to those of ordinary skill in the art, some of the steps above may be omitted or their sequence altered. For instance, hot rolling 14 is not required if the strip is continuously cast. Also, the strip may be formed by other heat treatments such as extrusion. In addition, the present invention applies to alloys that are initially cast into a rod or wire form prior to being rolled into a strip. Also, the end product may be wire.

In order to produce an alloy having the desired strength, there should be at least one cold deformation step, however, additional steps may be added as shown in FIG. 5. Also, the solution annealing 18 may be conducted in two steps.

Turning to FIG. 6, another example of the initial processing is provided. In the first step, the alloy is continuously cast 50. In contrast, the alloy could be cast and then hot rolled as described previously. In the first cold deformation step 52, the alloy is deformed by at least 80%. The alloy is then solution annealed 54 to a grain size of maximum 0.015 mm in combination with an electrical conductivity of max 26% IACS. Next, the alloy is cold deformed in step 56 between 10 to 50% prior to the precipitation annealing 22 (FIG. 5).

Turning to FIG. 7, the last step is precipitation annealing 22 followed by a cooling period 24. The precipitation annealing 30 is described in greater detail below in connection with the following example.

EXAMPLE 3

Figure 1:
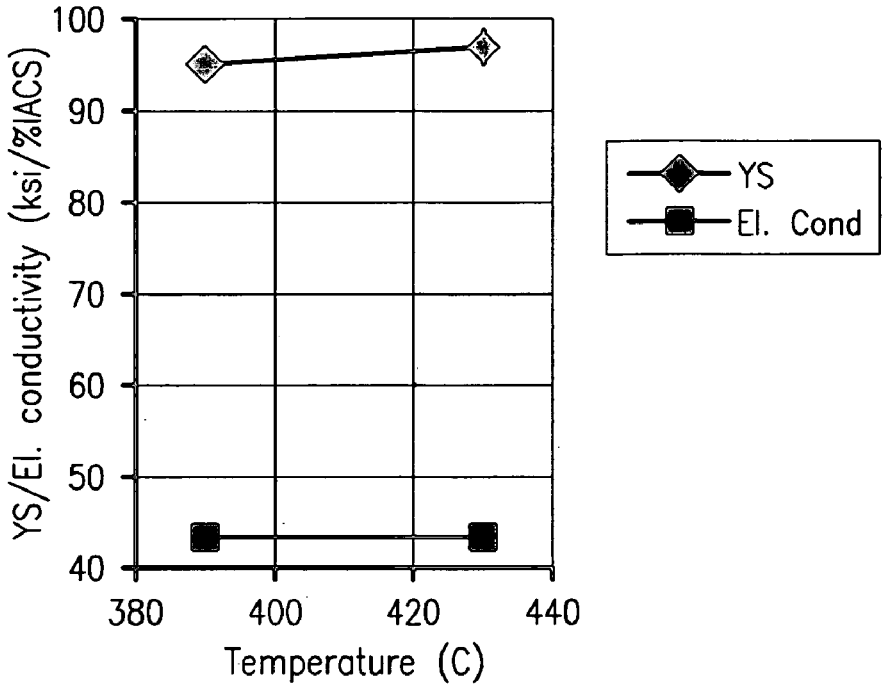
FIG. 1 is a graph showing the yield strength and conductivity for known material that was precipitation annealed in a batch furnace for four hours at different temperatures.
Figure 2:
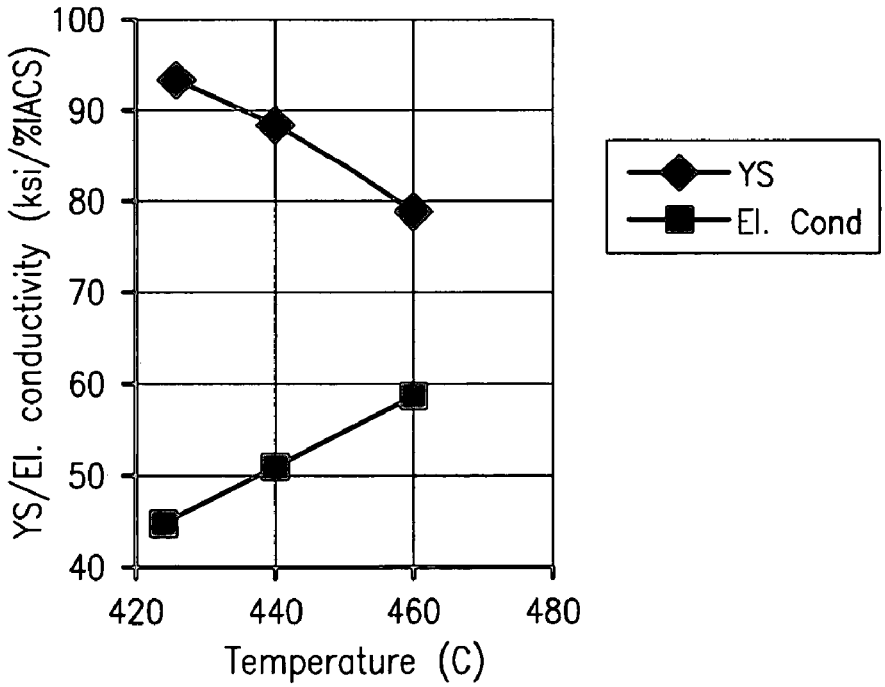
FIG. 2 is a graph showing the yield strength and conductivity for known material that was precipitation annealed in a batch furnace for eight hours at different temperatures.
Figure 3:
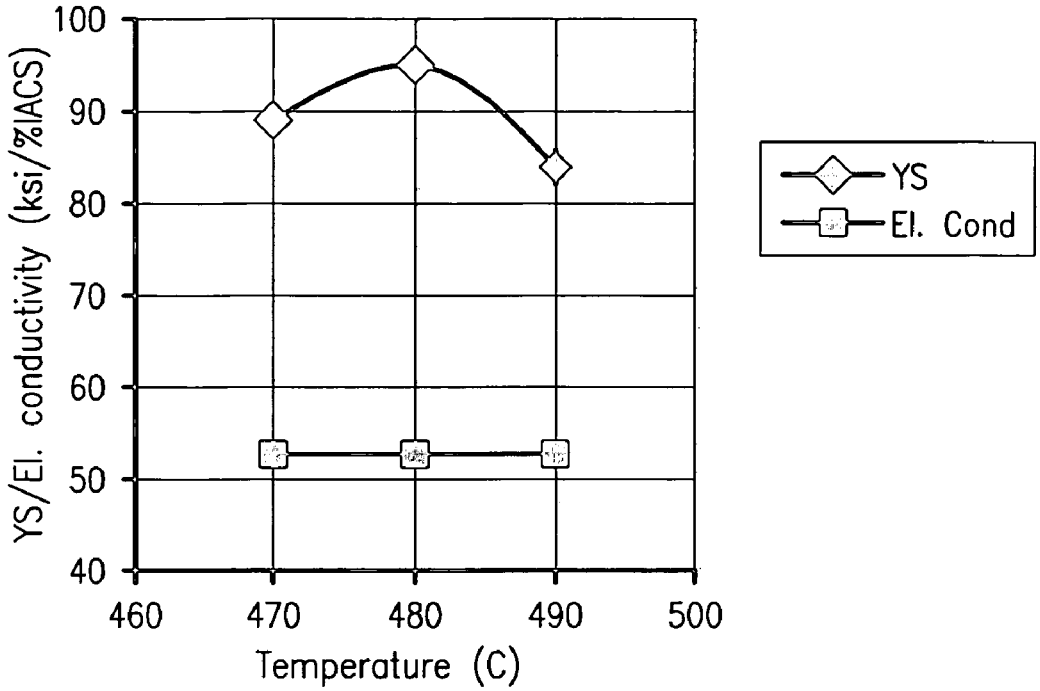
FIG. 3 is a graph showing the yield strength and conductivity for material that was manufactured by the process of the present invention.

A copper-nickel-silicon alloy formed by the above-described process was precipitation annealed in a batch furnace for eight hours at temperatures between 470° C. and 490° C. After annealing, the material was cooled to about 300° C. at a cooling rate of 10-20° C./hour. The results are shown in FIG. 3. The electrical conductivity was above 50% IACS for all temperatures, but the yield strength reached a peak above 90 ksi at approximately 480° C.

Accordingly, the temperature for precipitation annealing and the cooling rate enabled a strip to achieve a combination of strength and conductivity that was not possible in Examples 1 and 2.

EXAMPLE 4

Figure 4:
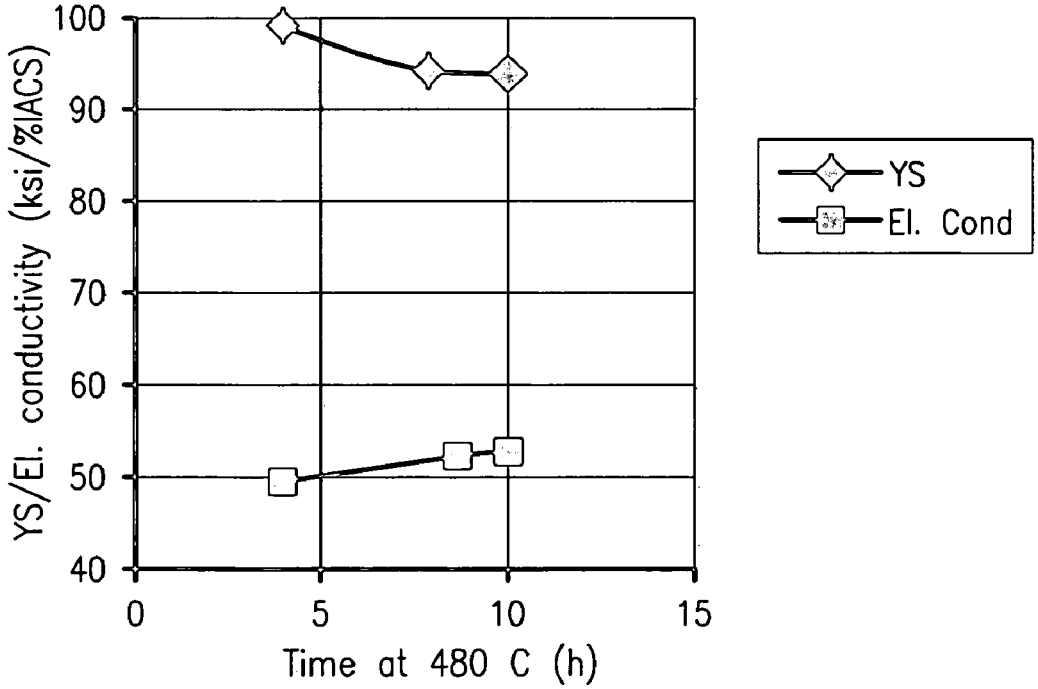
FIG. 4 is a graph showing the yield strength and conductivity for material that was manufactured by the process of the present invention.

A copper-nickel-silicon alloy formed by the above-described process was precipitation annealed in a batch furnace for 4, 8, and 10 hours at a temperature of 480° C. After annealing the material was cooled to about 300° C. at a very slow rate of 10-20° C./hour. The result after annealing is shown in FIG. 4. As shown, 4 hours appears to be a lower limit for reaching the desired conductivity.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed:

1. A process for producing a high strength and high electrical conductivity copper, comprising:

melting and casting raw material to obtain an alloy containing 1-3 wt. % nickel, 0.2-0.7 wt. % silicon, remainder copper and unavoidable impurities;

solution annealing the alloy to produce an annealed alloy having a grain size up to 0.015 mm and an electrical conductivity of up to 26% IACS;

cold deforming the annealed alloy to produce a cold-deformed annealed alloy;

precipitation annealing the cold-deformed alloy at a temperature of 450-500° C. for four to ten hours with a cooling rate of 10-20° C./hour between the annealing temperature and a temperature of approximately 300° C.; and obtaining a copper alloy having a yield strength of at least 90 ksi and an electrical conductivity of at least 50% IACS.

2. The process of claim 1, wherein phosphorous up to 0.010 wt. % is added as a deoxidizer during the melting step.

3. The process of claim 1, wherein the raw material is cast into an ingot.

4. The process of claim 3, wherein the ingot is hot rolled.

5. The process of claim 1, wherein the raw material is continuously cast.

6. The process of claim 1, further comprising the step of cold deforming the alloy prior to solution annealing.

7. The process of claim 1, wherein the cold deforming comprises cold rolling.

8. The process of claim 1, wherein the cold deforming comprises drawing.

9. The process of claim 1, further comprising a first cold deforming step prior to solution annealing with a reduction rate of at least 80% and a second cold deforming step after solution annealing with a reduction rate of 10 to 50%.

10. A process for producing copper alloy with high strength and high conductivity, comprising:

melting and continuously casting raw material to obtain a alloy containing 1-3 wt. % nickel, 0.2 to 0.7 wt. % silicon, remainder copper and unavoidable impurities;

cold deforming the alloy to form a cold-rolled alloy;

solution annealing the cold-rolled alloy to produce an annealed alloy having a grain size up to 0.015 mm and an electrical conductivity of up to 26% IACS;

cold rolling the annealed alloy to form a cold-rolled annealed alloy;

precipitation annealing the cold-rolled annealed alloy at a temperature of 450-500° C. for four to ten hours with a cooling rate of 10-20° C./hour; and obtaining a copper alloy having a yield strength of at least 90 ksi and an electrical conductivity of at least 50% IACS.

11. A process for producing a high strength and high electrical conductivity copper, comprising:

melting and casting raw material to obtain an alloy containing 1-3 wt. % nickel, 0.2-0.7 wt. % silicon, remainder copper and unavoidable impurities;

cold deforming the alloy with at least 80% reduction;

solution annealing the cold deformed alloy to a grain size of up to 0.015 mm in combination with an electrical conductivity up to 26% IACS;

cold rolling the cold deformed annealed alloy to between 10 and 50% reduction;

precipitation annealing the cold rolled annealed alloy at a temperature of 450-500° C. for four to ten hours with a cooling rate of 10-20° C./hour between the annealing temperature and a temperature of approximately 300° C.; and obtaining a copper alloy having a yield strength of at least 90 ksi and an electrical conductivity of at least 50% IACS.

12. The process of claim 11, wherein phosphorous up to 0.010 wt. % is added as a deoxidizer during the melting step.

13. The process of claim 11, wherein the raw material is cast into an ingot.

14. The process of claim 13, wherein the ingot is hot rolled.

15. The process of claim 11, wherein the raw material is continuously cast.

16. The process of claim 11, wherein the cold deforming comprises cold rolling.

17. A process for producing copper alloy with high strength and high conductivity, comprising:

melting and casting raw material to obtain an alloy containing 1-3 wt. % nickel, 0.2 to 0.7 wt. % silicon, remainder copper and unavoidable impurities;

hot rolling the alloy to form a hot rolled alloy;

cold rolling the hot rolled alloy to form a cold-rolled alloy;

solution annealing the cold-rolled strip to produce an annealed alloy having a grain size up to 0.015 mm and an electrical conductivity of up to 26% IACS;

cold rolling the annealed alloy to form a cold-rolled annealed alloy;

precipitation annealing the cold-rolled annealed alloy at a temperature of 450-500° C. for four to ten hours with a cooling rate of 10-20° C./hour; and obtaining a copper alloy having a yield strength of at least 90 ksi and an electrical conductivity of at least 50% IACS.

* * * * *